US007998401B2

(12) United States Patent
Okaniwa et al.

(10) Patent No.: US 7,998,401 B2
(45) Date of Patent: Aug. 16, 2011

(54) METHOD FOR PRODUCING ALUMINUM COMPOSITE MATERIAL

(75) Inventors: Shigeru Okaniwa, Shizuoka (JP); Shigeki Aoyama, Tokyo (JP); Toshimasa Nishiyama, Niigata (JP); Hiroaki Kita, Aichi (JP)

(73) Assignees: Nippon Light Metal Company, Ltd., Tokyo (JP); Nikkeikin Aluminium Core Technology Company, Ltd., Tokyo (JP)

( * ) Notice: Subject to any disclaimer, the term of this patent is extended or adjusted under 35 U.S.C. 154(b) by 977 days.

(21) Appl. No.: 11/813,046

(22) PCT Filed: Dec. 28, 2005

(86) PCT No.: PCT/JP2005/024102

§ 371 (c)(1),
(2), (4) Date: Oct. 12, 2007

(87) PCT Pub. No.: WO2006/070879

PCT Pub. Date: Jul. 6, 2006

(65) Prior Publication Data

US 2008/0131719 A1 Jun. 5, 2008

(30) Foreign Application Priority Data

Dec. 28, 2004 (JP) ..... 2004-378938

(51) Int. Cl.
*B22F 7/04* (2006.01)
*B22F 3/105* (2006.01)

(52) U.S. Cl. ..... 419/8; 419/10; 419/28; 419/52

(58) Field of Classification Search ..... 419/2, 8, 419/10, 28, 52
See application file for complete search history.

(56) References Cited

U.S. PATENT DOCUMENTS

| | | | | |
|---|---|---|---|---|
| 3,065,073 | A * | 11/1962 | Hug | 419/8 |
| 4,027,377 | A * | 6/1977 | Roszler | 419/50 |
| 5,384,087 | A * | 1/1995 | Scorey | 419/10 |
| 5,700,962 | A * | 12/1997 | Carden | 75/236 |
| 6,371,746 | B1 * | 4/2002 | Shiomi et al. | 425/78 |
| 6,602,314 | B1 * | 8/2003 | Sakaguchi et al. | 75/249 |
| 6,630,100 | B1 * | 10/2003 | Murakami et al. | 419/12 |
| 7,625,520 | B2 * | 12/2009 | Peng et al. | 419/8 |
| 2004/0141866 | A1 * | 7/2004 | Forsberg et al. | 419/8 |
| 2006/0153728 | A1 * | 7/2006 | Schoenung et al. | 419/32 |

FOREIGN PATENT DOCUMENTS

| | | |
|---|---|---|
| JP | 5 93205 | 4/1993 |
| JP | 10 245642 | 9/1998 |
| JP | 2000 316688 | 11/2001 |

* cited by examiner

*Primary Examiner* — Roy King
*Assistant Examiner* — Ngoclan T Mai
(74) *Attorney, Agent, or Firm* — Oblon, Spivak, McClelland, Maier & Neustadt, L.L.P.

(57) ABSTRACT

A method for producing an aluminum composite material having a great content of a ceramics with ease. The method (a) mixes an aluminum powder and ceramic particles, to prepare a mixed material, (b) subjects the mixed material to electric pressure sintering together with a metal sheet material, to form a clad material including a sintered product covered with the metal sheet material, and (c) subjects the clad material to a plastic working to prepare an aluminum composite material. In the (b) subjecting, the mixed material is sandwiched between a pair of metal sheets or a powder of the mixed material is held in a metal container, the mixed material is placed in a forming die in a state in which the metal sheet material is pressurized by a punch, and the mixed material is compressed together with the metal sheet material. The metal sheet material is made of aluminum or stainless steel.

21 Claims, 10 Drawing Sheets

[Fig. 1]
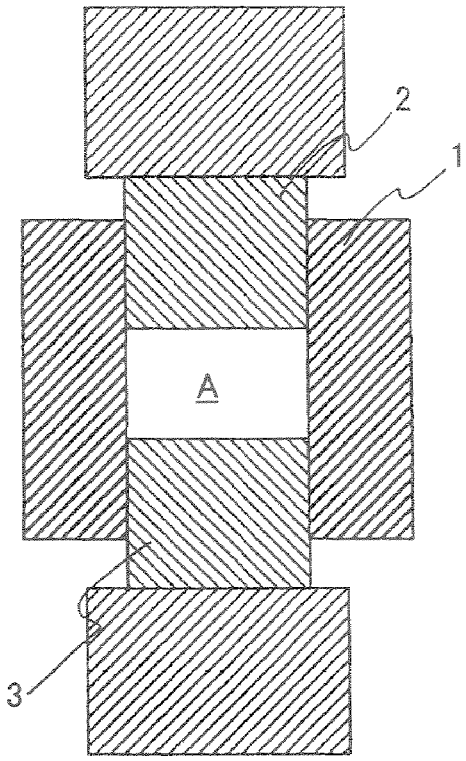
[Fig. 2]
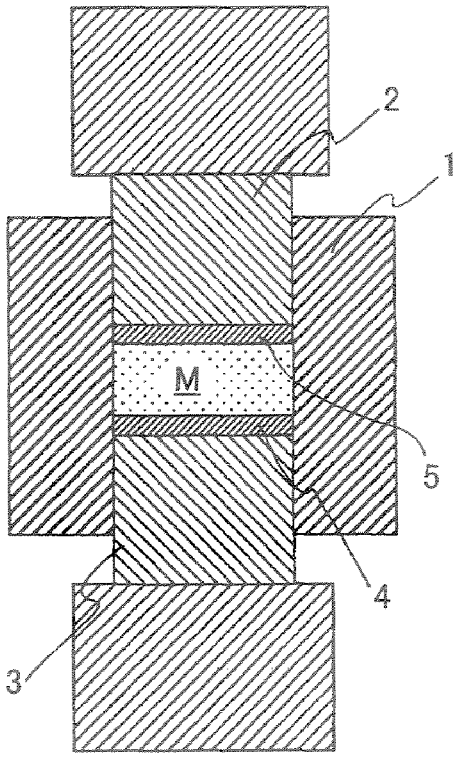

[Fig. 3]
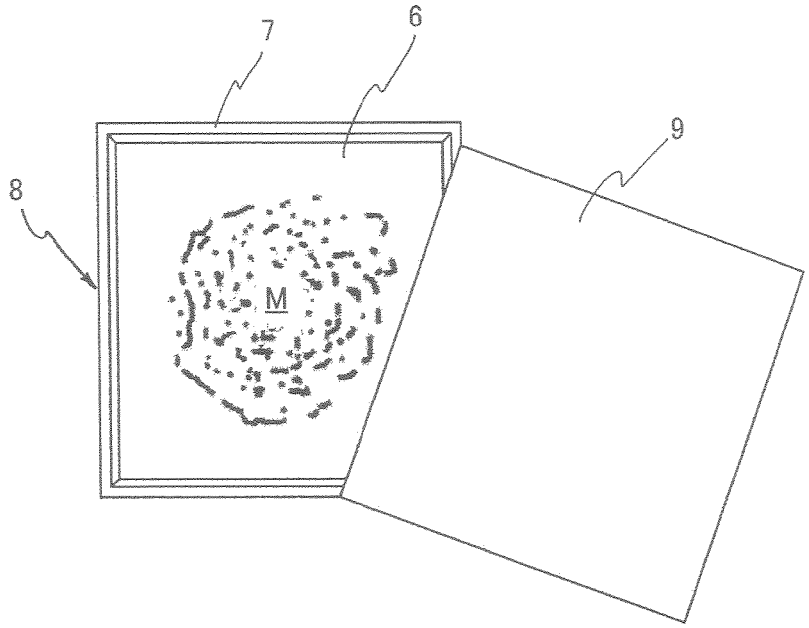
[Fig. 4]
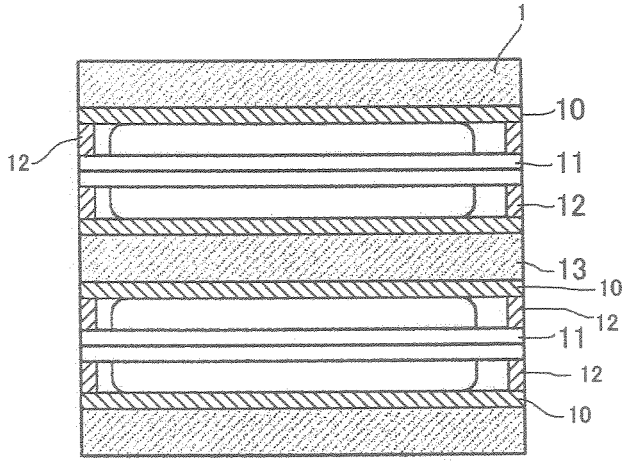
[Fig. 5]
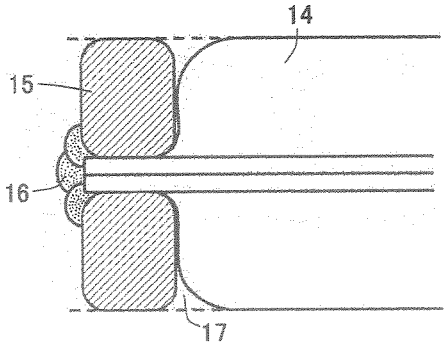

[Fig. 6]
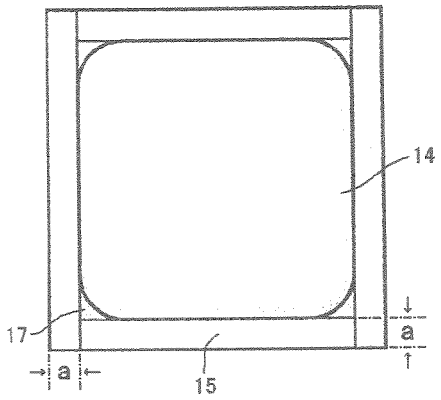
[Fig. 7]
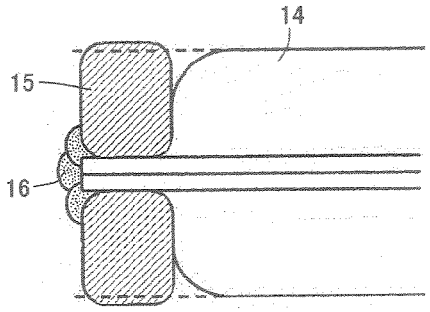
[Fig. 8]
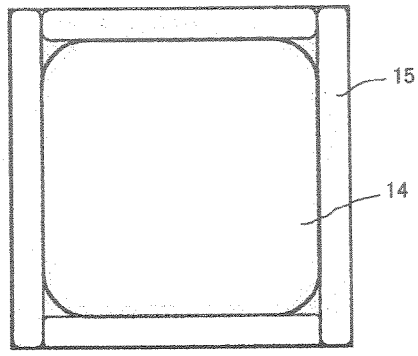
[Fig. 9]
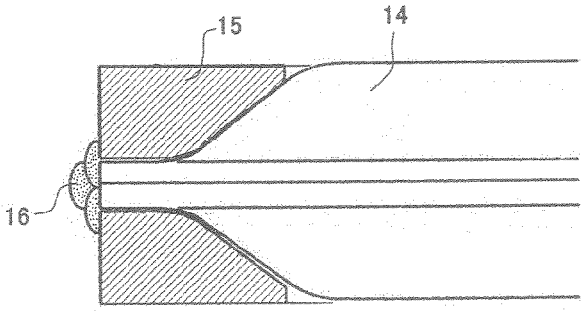

[Fig. 10]
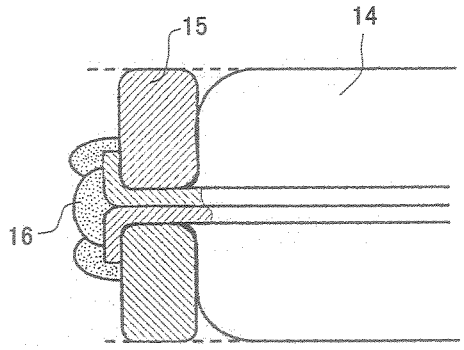
[Fig. 11]
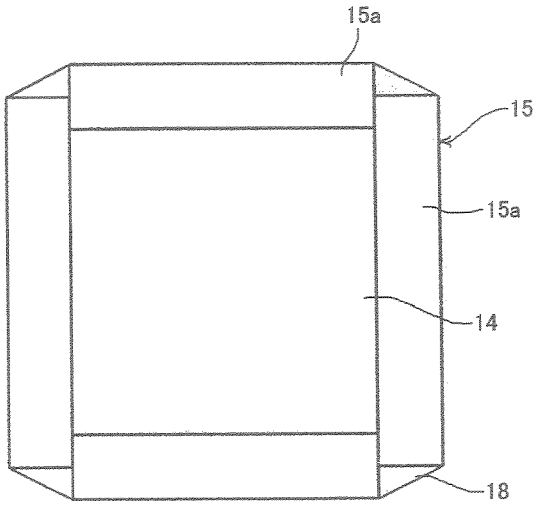
[Fig. 12]
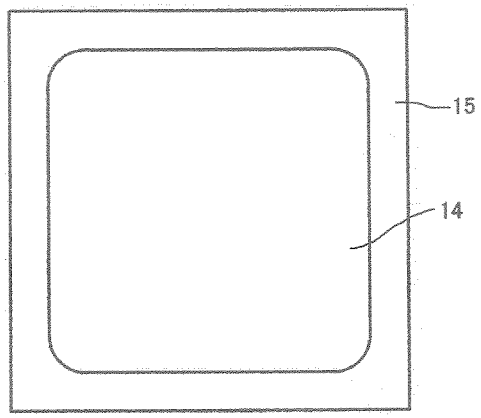
[Fig. 13]
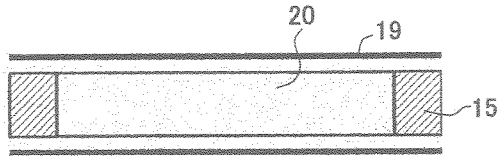

[Fig. 14]
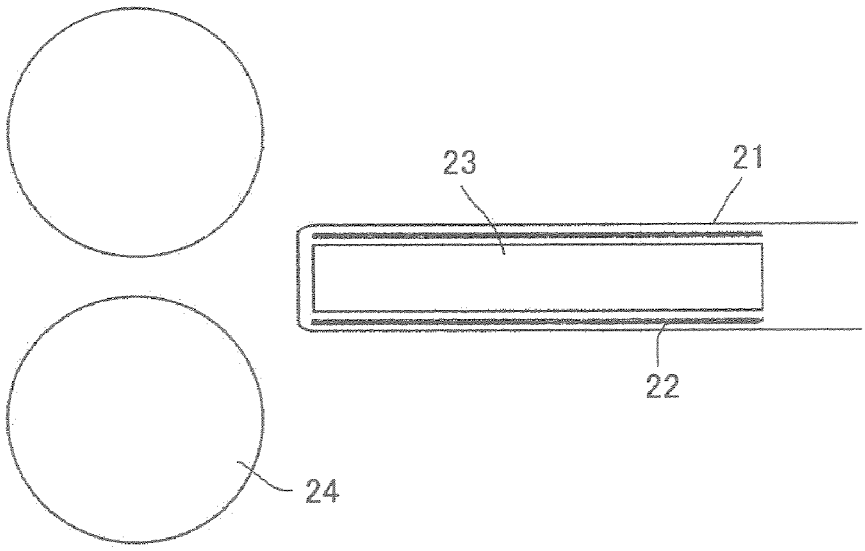

[Fig. 15]
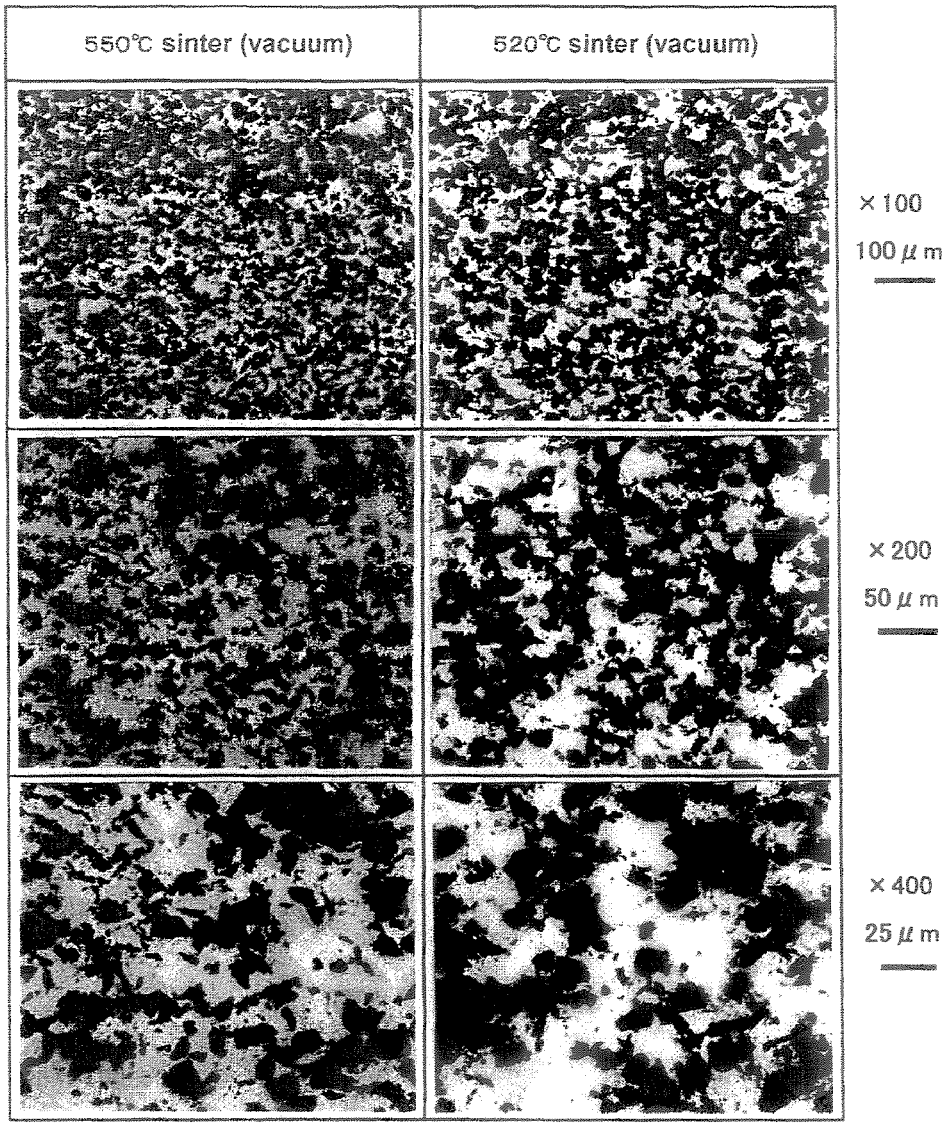
Sectional Microstructure of SPS Sintered Compact
(container 1050) (LT cross section)

[Fig. 16]
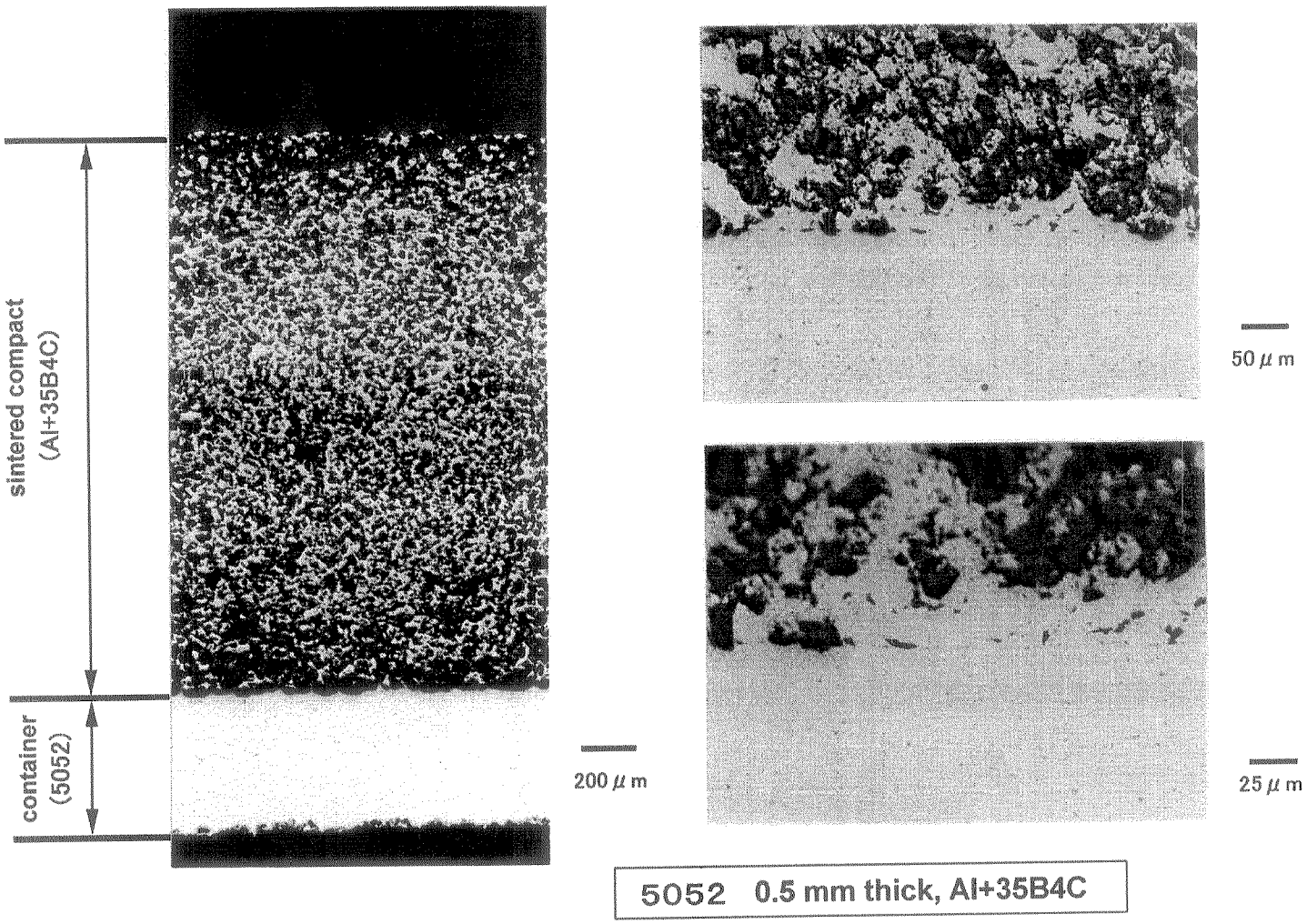

[Fig. 17]
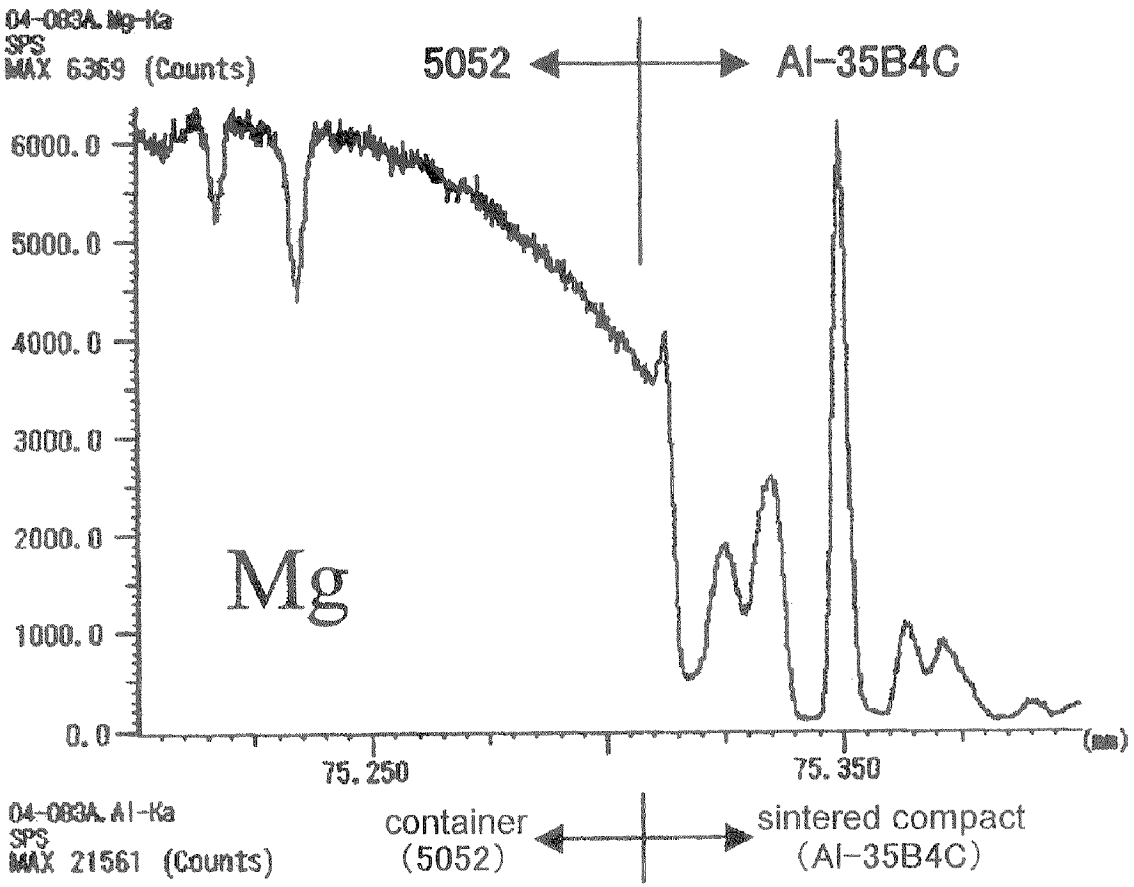

[Fig. 18]
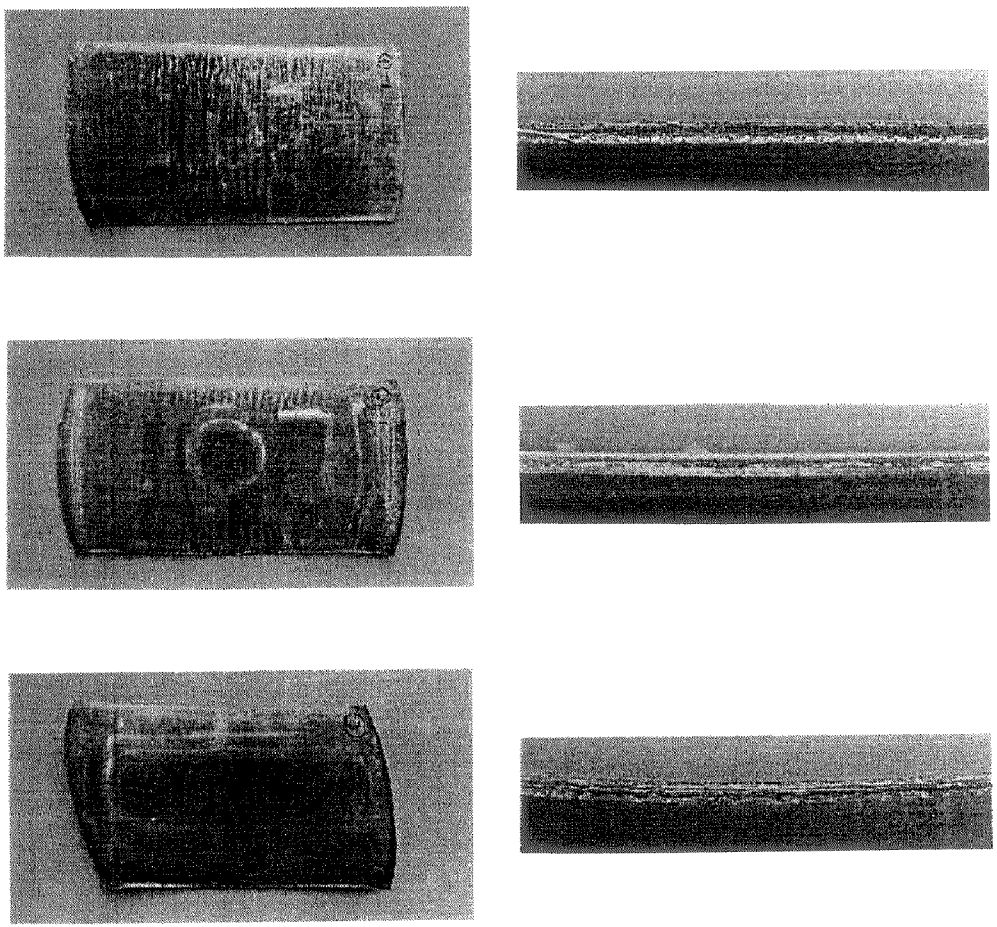
① container material 1050 550° sinter
② container material 1050 520° sinter
③ container material 1050 550° sinter

[Fig. 19]
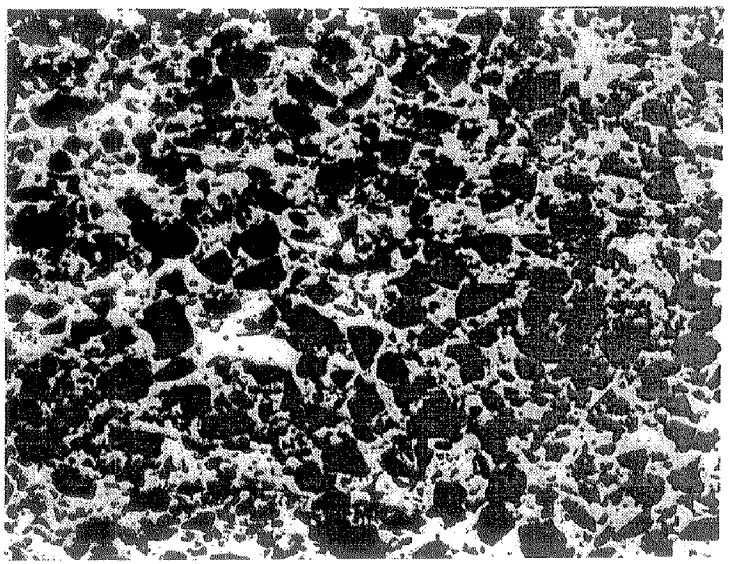
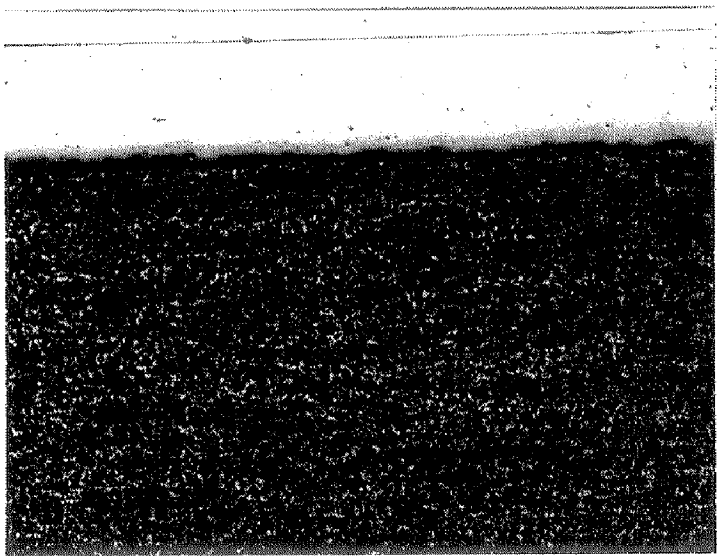
200 μm
25 μm
Al+43% $B_4C$ extruded material

METHOD FOR PRODUCING ALUMINUM COMPOSITE MATERIAL

TECHNICAL FIELD

The present invention generally relates to a method for producing an aluminum composite material, and more specifically relates to production of an aluminum composite material excelling in at least one property such as plastic workability thermal conductivity, strength at room temperature or high temperatures, high rigidity, neutron absorbing ability, wear resistance or low thermal expansion.

BACKGROUND ART

When using powder metallurgy to produce a composite material having aluminum as the matrix phase, ceramic particles of $Al_2O_3$, SiC or $B_4C$, BN, aluminum nitride and silicon nitride are mixed as reinforcing materials into an aluminum powder which forms the matrix phase, then this mixed powder is loaded into a can and cold-pressed or the like, then degassed or sintered to form the desired shape. Sintering methods include methods of simply heating, methods of heating while compressing such as hot-pressing, methods of pressure sintering by hot plastic working such as hot extrusion, hot forging and hot rolling, methods of sintering by passing electricity while compressing, and combinations of these methods. Additionally, the sintering can be performed together with the degassing.

Patent Document 1: JP 2001-329302 A

DISCLOSURE OF THE INVENTION

Problems to be Solved by the Invention

In recent years, aluminum composite materials have been developed, not only for its strength, but for other uses requiring a high Young's modulus, wear resistance, low thermal expansion, and radiation absorbing ability. In general, each function can be increased by increasing the amount of ceramics having the required function, but simply increasing the amounts can cause the plastic workability such as sintering ability, extrusion ability, rolling ability and forging ability to be largely reduced.

Therefore, methods of performing the ceramics, impregnating with an aluminum alloy melt, then evenly dispersing high-concentration ceramics in the matrix phase have been contemplated, but this carries the drawback of possible defects occurring due to inadequate penetration of the melt and shrinkage forming during solidification.

The present invention was made in consideration of the above situation, and has the object of offering a method enabling an aluminum composite material with a high ceramic content, such as 10% by mass, to be easily produced.

Another object of the present invention is to offer a method of producing an aluminum composite material which is more readily subjected to plastic working by cladding an aluminum-ceramic composite material with a metallic plate.

A further object of the present invention is to offer a method of producing an aluminum composite material capable of reliably preventing the generation of cracks or the like when subjecting a clad aluminum-ceramic composite material to rolling.

Yet a further object of the present invention is to offer a method of producing an aluminum composite material capable of achieving a high productivity.

For the purposes of the present specification, aluminum shall refer to aluminum alloys as well as pure aluminum.

Additionally, the production method of the present invention is not limited to the production of aluminum composite materials with a high reinforcing material content, and can just as well be applied to production of aluminum composite alloys having a low reinforcing material content, such as 0.5% by mass.

Means for Solving the Problems

The method for producing an aluminum composite material according to the present invention is characterized by comprising (a) a step of mixing an aluminum powder and ceramic particles to prepare a mixed material; (b) a step of electric-current pressure sintering said mixed material together with a metallic plate material to form a clad material wherein a sintered compact is covered by a metallic plate material; and (c) a step of subjecting said clad material to plastic working to obtain an aluminum composite material.

Generally, ceramic particles are much harder than aluminum. Therefore, when a sintered compact of an aluminum powder containing large amounts of ceramic particles is plastically worked, the ceramic particles on the surface can be points of origin for damage, and cause cracks to occur in the plastically worked material. Additionally, they can cause wear in extrusion dies, mill rolls, forging dies and the like. However, in the present invention, the plastic working step is preceded by a step of covering the mixed material of aluminum powder and ceramic particles with a metallic plate material, electric-current pressure sintering, then cladding the surface of the ceramic-containing aluminum sintered compact with a metallic plate material, and performing plastic working in that state. With this method, there will be no ceramic particles on the surface that may be the point of origin for damage or wear down dies or the like, thus resulting in good plastic working materials. Additionally, the ceramic-containing aluminum powder is clad by a metallic plate material by means of electric-current pressure sintering, so there is close contact between the ceramic-containing aluminum material and the metallic plate material, thus providing excellent thermal conductivity and electrical conductivity between the ceramic-containing aluminum material and the metallic plate material. Additionally, even if subjected to hot plastic working, defects will not occur between the metallic plate material and the ceramic-containing aluminum material, so there is no need to separate the metallic plate material after hot plastic working.

In a preferred embodiment of the present invention, the aforementioned step (b) includes loading the aforementioned mixed material in a forming die together with a metallic plate material in a state of contact with the metallic plate material, and subjecting to electric-current pressure sintering while compressing with a punch and applying voltage. Here, this may involve sandwiching the mixed material between a pair of metallic plate materials, loading in a forming die with a metallic plate materials being pressed by a punch, and compressing the mixed material together with the metallic plate material, or as an alternative method, placing the mixed powder in a metallic container having a lid plate material opposite a bottom plate material, loading in a forming die with the bottom plate material and lid plate material pressed by a punch, and compressing the mixed material together with the container.

In a further preferred embodiment of the present invention, the aforementioned step (b) may involve preparing at least two assemblies of a mixed material and metallic plate materials and performing the electric-current pressure sintering with the aforementioned at least two assemblies loaded in a forming die in a stacked state, to simultaneously form at least two clad materials, and this method can greatly improve the productivity. Here, a receiving space inside the forming die can be partitioned by at least one partitioning member perpendicular to the punch movement direction to delimit at least two compartments, the aforementioned at least two assemblies being loaded into the aforementioned at least two compartments to perform the electric-current pressure sinter.

In another preferred embodiment of the present invention, the aforementioned metallic plate material is composed of aluminum or stainless steel. Additionally, in the aforementioned step (a), the usual procedure would be to mix an aluminum powder and ceramic particles to prepare a mixed material consisting of a mixed powder, but the mixed material may consist of a compressed formed compact formed by compression forming a mixed powder of an aluminum powder and ceramic particles, for example, by a cold isostatic press (CIP), cold uniaxial press or vibration press, and may be subjected to electric-current pressure sintering beforehand, due to which it becomes easier to sinter during electric-current pressure sintering and easier to handle such as during transport. Additionally, it can be compression formed with a mixed powder loaded into a metallic container or a mixed powder between metallic plate materials.

In vet another embodiment of the present invention, in the aforementioned step (a), the aluminum powder may be an alloy powder is a pure Al powder with a purity of at least 99.0% or an alloy powder containing Al and 0.2-2% by mass of at least one of Mg, Si, Mn and Cr, and the ceramic particles may take up 0.5-60% of the total mass of the mixed material.

In a further preferred embodiment of the present invention, the aforementioned step (b) can involve forming a clad material with peripheral portions covered by a metallic frame material. More preferably, the aforementioned step (b) can involve covering the clad material with a metallic frame material after electric-current pressure sintering. In an alternative method, the peripheral portions of the metallic plate materials and/or the mixed material may be covered by a metallic frame material before electric-current pressure sintering. Here, the aforementioned metallic frame material may be formed by welding, friction stir welding (FSW welding) or the like of a plurality of frame members, or may be a single piece. Preferably, the metallic frame material is a single piece obtained by cutting out the central portion of an aluminum plate material by wire cutting or pressing, or a hollow extruded material cut to an appropriate length.

In a further embodiment of the present invention, the aforementioned step (c) may involve covering the surface of the aforementioned clad material with a metallic protective plate before subjecting to plastic working. Here, the aforementioned protective plate is preferably composed of a material that is malleable, has good high temperature strength, and low thermal conductivity. For example, stainless steel, Cu, soft iron or the like can be used, among which soft iron is most preferable. Additionally the aforementioned step (c) more preferably involves covering the aforementioned clad material with the aforementioned protective plate on the front side in the direction of movement and on the top and bottom surfaces. Furthermore, lubrication is preferably performed between the aforementioned clad material and protective plate such as by solid lubrication using a BN-based lubricant.

Another embodiment of the present invention offers an aluminum composite material produced by one of the above-described methods of producing an aluminum composite material.

Effects of the Invention

The method of producing an aluminum composite material according to the present invention partially or completely resolves the aforementioned drawbacks of conventional methods of producing aluminum composite materials.

In particular, with the method of producing an aluminum composite material according to the present invention, a metallic plate material and a mixed material of an aluminum powder and ceramic particles are together subjected to electric-current pressure sintering before performing plastic working, thus cladding a ceramic-containing aluminum sintered compact with the metallic plate material, as a result of which there are no ceramic particles on the surface that may be points of origin of damage or wear down dies or the like, resulting in a good plastic working material. Additionally, the ceramic-containing aluminum material is clad by a metallic plate material by means of electric-current pressure sintering, so there is close contact between the ceramic-containing aluminum material and the metallic plate material, and excellent thermal conductivity and electrical conductivity between the ceramic-containing aluminum material and the metallic plate material. Additionally defects will not occur between the metallic plate material and the ceramic-containing aluminum material even if plastic working is performed.

Additionally, in a preferred embodiment of the method of producing an aluminum composite material according to the present invention, at least two assemblies of a mixed material and metallic plate materials are simultaneously loaded into a forming die, and subjected to electric-current pressure sintering, thus enabling the efficiency of the sintering step to be raised and greatly improving the productivity of the aluminum composite material.

In further preferred embodiments, the peripheral portions of the clad material are covered by a metallic frame material or the surface of the clad material is covered by a metallic protective plate before performing the rolling procedure, thereby achieving the effect of reliably preventing cracks, fissures and the like from occurring on the surface, interior or sides of the composite material due to plastic working.

Additionally multi-stacked sintering has the effect of allowing the plate thickness to be freely controlled by the use of a spacer.

DESCRIPTION OF THE DRAWINGS

FIG. 1 A schematic section view showing the essential portions of an electric current pressure sintering device used to work the present invention.

FIG. 2 A schematic view of an embodiment of the method of the present invention, wherein a mixed powder is received between a pair of metallic plate materials at top and bottom, then loaded into an electric-current pressure sintering device.

FIG. 3 A schematic view of another embodiment of the present invention, wherein the mixed powder is received in a metallic container loaded into the electric-current pressure sintering device.

FIG. 4 A schematic section view of an electric-current pressure sintering device showing another embodiment of the method of the present invention, showing an example of two-stage sintering.

FIG. 5 A partial section view showing another embodiment of the method of the present invention, wherein a metallic frame material is attached to the edge portion of a container comprising a box-shaped element and a lid member.

FIG. 6 A plan view showing the entirety of the container of FIG. 5 having a frame material attached to the edge portion thereof.

FIG. 7 A partial section view similar to FIG. 5, showing another example of attachment of a metallic frame material to the edge portion of a container.

FIG. 8 A plan view showing the entirety of the container of FIG. 7 having a frame material attached to the edge portion thereof.

FIG. 9 A partial section view similar to FIG. 5, showing yet another example of attachment of a metallic frame material to the edge portion of a container.

FIG. 10 A partial section view similar to FIG. 5, showing still another example of attachment of a metallic frame material to the edge portion of a container.

FIG. 11 A plan view of the entirety of a container similar to FIG. 6, wherein the corners of the metallic frame material have been welded.

FIG. 12 A plan view of the entirety of a container having a wire-cut type metallic frame attached thereto.

FIG. 13 A schematic section view of another embodiment of the present invention, showing how a metallic frame material is attached to the edge portions of a mixed material to simultaneously sinter the mixed material and the frame material.

FIG. 14 A schematic view showing another embodiment of the method of the present invention, wherein the surface of the clad material is covered by a protective plate before plastic working.

FIG. 15 Microscope photographs of a sintered compact that has been electric-current pressure sintered in accordance with the method described in Example 1 of the present invention, using rectangular containers of aluminum, alloy JIS5052 and JIS1050.

FIG. 16 Microscope photographs of the boundary surface between a sintered compact and a metallic container of the sintered material that has been electric-current pressure sintered in accordance with the method described in Example 1 of the present invention, using rectangular containers of aluminum alloy JIS5052 and JIS1050.

FIG. 17 A diagram showing a line analysis of Mg in the sintered compacts of FIGS. 15 and 16.

FIG. 18 A photograph of a rolled material obtained by cold rolling an electric-current pressure sintered compact containing a sintered compact according to FIGS. 15 and 16.

FIG. 19 A microscopic structure photograph of an extruded material produced by the method described in Example 2.

1 forming die
2 upper punch member
3 lower punch member
A material receiving portion
4, 5 metallic plate material
6 bottom plate member
9 lid plate member
10 stacked plates
11 assembly
12 spacer
13 partition member
14 container
15 frame material
16, 18 welded portion
17 gap portion
21 protective plate
24 mill roll

BEST MODES FOR CARRYING OUT THE INVENTION

The method of production of the present invention is characterized by a step of mixing an aluminum powder and ceramic particles to prepare a mixed material, (b) a step of electric-current pressure sintering said mixed material together with a metallic plate material to form a clad material wherein a sintered compact is covered by a metallic plate material, and (c) a step of plastic working said clad material to obtain an aluminum composite material. Here below, the raw materials used shall be explained, followed by a detailed explanation of the respective steps in the order of steps (a) through (c).

(1) Explanation of Raw Materials

[Aluminum Powder of Matrix Material]

While the composition of the aluminum powder to form the matrix material of the main body portion is not particularly restricted, it is possible to use various types of alloy powders such as pure aluminum (JIS1050, 1070 etc.), Al—Cu alloys (JIS2017 etc.), Al—Mg alloys (JIS5052 etc.), Al—Mg—Si alloys (JIS6061 etc.), Al—Zn—Mg alloys (JIS7075 etc.) and Al—Mn alloys, either alone or as a mixture of two or more.

The composition of the aluminum alloy powder to be selected can be determined in consideration of the desired properties, deformation resistance in subsequent forming steps, amount of ceramic particles mixed, and raw material costs. For example, when wishing to increase the workability or heat dissipation of the aluminum composite material, a pure aluminum powder is preferable. A pure aluminum powder is also advantageous in terms of raw material costs as compared with the case of aluminum alloy powders. As the pure aluminum powder, it is preferable to use one with a purity of at least 99.5% by mass (commercially available pure aluminum powders usually have a purify of at least 99.7% by mass).

Additionally; when wishing to obtain neutron absorbing ability, a boron compound is used as the ceramic particles to be described below, but when wishing to further increase the resulting neutron absorbing ability, it is preferable to add 1-50% by mass of one type of element providing neutron absorbing ability such as hafnium (Hf), samarium (Sm) or gadolinium (Gd) to the aluminum powder. Additionally, when high-temperature strength is required, it is possible to add at least one element chosen from titanium (Ti), vanadium (V), chrome (Cr), manganese (Mn), iron (Fe), copper (Cu), nickel (Ni), molybdenum (Mo), niobium (nb), zirconium (Zr) and strontium (Sr), and when room-temperature strength is required, it is possible to add at least one element chosen from silicon (Si), copper (Cu), magnesium (Mg) and zinc (Zn), at a proportion of 2% by mass or less for each element, and a total of 15% by mass or less.

Furthermore, while the sintering ability must be increased in the present invention, it is preferable to include at least 0.2% by mass of at least one of Mg (magnesium), Cu (copper) or Zn (zinc) in order to fulfill this purpose.

In the above-described aluminum alloy powders, the balance other than the specified ingredients basically consists of aluminum and unavoidable impurities.

While the average particle size of the aluminum powder is not particularly restricted, the powder should generally have an upper limit of 500 μm or less, preferably 150 μm or less and more preferably 60 μm or less. While the lower limit of the average particle size is not particularly limited as long as producible, it should generally be 1 μm or more, preferably 20 μm or more. Additionally, if the particle size distribution of the aluminum powder is made 100 μm or less and the average particle size of the particles of the reinforcing material is made 10 μm or less, then the particles of the reinforcing material will be evenly dispersed, thus greatly reducing the portions where the reinforcing material particles are thin, and providing a property stabilizing effect. Since cracks will tend to occur if plastic working such as extrusion or rolling is performed with a large difference between the average particle size of the aluminum alloy powder and the average particle size of the ceramic particles discussed below, the difference in average particle size should preferably be small. If the average particle size becomes too large, it becomes difficult to achieve an even mixture with ceramic particles whose average particle size cannot be made too large, and if the average particle size becomes too small, the fine aluminum alloy powder can clump together, making it extremely difficult to obtain an even mixture with the ceramic particles. Additionally, by putting the average particle size in this range, it is possible to achieve greater workability, formability and mechanical properties.

For the purposes of the present invention, the average particle size shall refer to the value measured by laser diffraction particle size distribution measurement. The shape of the powder is also not limited, and may be any of teardrop-shaped, spherical, ellipsoid, flake-shaped or irregular.

The method of production of the aluminum powder is not limited, and it may be produced by publicly known methods of production of metallic powders. The method of production can, for example, be by atomization, melt-spinning, rotating disk, rotating electrode or other rapid-cooling solidification method, but an atomization method, particularly a gas atomization method wherein a powder is produced by atomizing a melt is preferable for industrial production.

In the atomization method, the above melt should generally by heated to 700-1200° C., then atomized. By setting the temperature to this range, it is possible to perform atomization more effectively. Additionally, the spray medium/atmosphere for the atomization may be air, nitrogen, argon, helium, carbon dioxide, water or a mixed gas thereof, the spray medium should preferably be air, nitrogen gas or argon gas in view of economic factors.

[Ceramic Particles]

Examples of the ceramic to be mixed with the aluminum powder to form the main body portion include $Al_2O_3$, SiC or $B_4C$, BN, aluminum nitride and silicon nitride. These may be used alone or as a mixture, and selected depending on the intended use of the composite material.

Here, boron (B) has the ability to absorb neutrons, so the aluminum composite material can be used as a neutron-absorbing material if boron-containing ceramic particles are used. In that case, the boron-containing ceramic can be, for example, $B_4C$, $TiB_2$, $B_2O_3$, FeB or $FeB_2$, used either alone or as a mixture. In particular, it is preferable to use boron carbide $B_4C$ which contains large amounts of $^{10}B$ which is an isotope of B that absorbs neutrons well.

The ceramic particles should be contained in the aforementioned aluminum alloy powder in an amount of 0.5% to 60% by mass, more preferably 5% to 45% by mass. The reason the content should be at least 0.5% by mass is that at less than 0.5% by mass, it is not possible to adequately reinforce the composite material. Additionally, the reason the content should be 60% by mass or less is because if it exceeds 60% by mass, then sintering becomes difficult, the deformation resistance for plastic working becomes high, plastic workability becomes difficult, and the formed article becomes brittle and easily broken. Additionally, the adhesion between the aluminum and ceramic particles becomes poor, and gaps can occur, thus not enabling the desired functions to be obtained and reducing the strength and thermal conductivity. Furthermore, the cutting ability is also reduced.

While the average particle size of the $B_4C$ or $Al_2O_3$ ceramic particles is arbitrary, it is preferably 1-20 μm. As explained with regard to the average particle size of the aluminum alloy, the difference in particle size between these two types of powders is preferably small. Therefore, the particle size should more preferably be at lease 5 μm and at most 20 μm. If the average particle size is greater than 20 μm, then the teeth of the saw can quickly wear away during cutting, and if the average particle size is smaller than 1 μm (preferably 3 μm), then these fine powders may clump together, making it extremely difficult to achieve an even mixture with the aluminum powder.

For the purposes of the present invention, the average particle size shall refer to the value measured by laser diffraction particle size distribution measurement. The shape of the powder is also not limited, and may be any of teardrop-shaped, spherical, ellipsoid, flake-shaped or irregular.

[Metallic Plate Material]

While the metallic plate material used in the method of production of the present invention may consist of any metal as long as the metal excels in adhesion to the powder material and is suitable for plastic working, it should preferably be of aluminum or stainless steel. For example, in the case of aluminum, pure aluminum (JIS1050, 1070 etc.) can be preferably used, as well as various types of alloy materials such as Al—Cu alloy (JIS2017 etc.), Al—Mg alloy (JIS5052 etc.), Al—Mg—Si alloy (JIS6061 etc.), Al—Zn—Mg alloy (JIS7075 etc.) and Al—Mn alloy. The composition of the aluminum selected should be determined in consideration of the desired properties, cost and the like. For example, when wishing to improve the workability and heat dissipation ability, pure aluminum is preferable. Pure aluminum is also preferable in terms of raw material cost as compared with aluminum alloys. Additionally, when wishing to improve the strength or workability, an Al—Mg alloy (JIS5052 etc.) is preferable. Furthermore, when wishing to further improve the neutron absorbing ability, it is possible to add preferably 1-50% by mass of at least one element having neutron-absorbing ability; such as Hf, Sm or Gd.

Additionally, as shall be described in detail in connection with the electric-current pressure sintering step below, the metallic plate material may be a pair of metallic plate materials, or a container wherein a lid plate material is combined with a box element comprising a bottom plate material and side plate materials. In the case of a container, a step-shaped mating portion can be formed on the upper edge portions of the box element so as to mate with the peripheral portions of the lid plate element.

(2) Step (a) (Aluminum-Ceramic Mixture Production Step)

An aluminum powder and ceramic particles are prepared, and these powders are uniformly mixed. The aluminum powder may be of one type alone, or may be a mixture of a plurality of types, and the ceramic particles may likewise consist of one type alone or a plurality of types, such as by mixing in $B_4C$ and $Al_2O_3$. The method of mixture may be a publicly known method, for example, using a mixer such as a V blender or cross-rotary mixer, or a vibrating mill or planetary mill, for a designated time (e.g. 10 minutes to 10 hours). Additionally, the mixture can be performed under dry or wet conditions. Furthermore, media such as alumina balls or the like can be added for the purposes of crushing during mixture.

Step (a) merely concerns preparation of a powder mixture, and the basic process involves sending the powder mixture to the next electric-current pressure sintering step, but in some cases, it is possible to compression form the mixed aluminum powder by subjecting to a cold isostatic press (CIP), cold uniaxial press or vibration press prior to the subsequent electric-current pressure sintering step, and it may further be subjected to electric-current pressure sintering beforehand. By forming a compression formed material instead of using a mixed powder as is, the material becomes easier to sinter during electric-current pressure sintering, as well as becoming easier to handle during transport or the like. Furthermore, the compression formed material can be heated to 200-600° C. and degassed in a reduced pressure atmosphere, an inert atmosphere or a reducing atmosphere.

(3) Step (b) (Electric-Current Pressure Sintering Step)

In step (b), the mixture (mixed powder or mixed compression formed compact) produced in step (a) is loaded into an electric-current pressure sintering device and subjected to electric-current pressure sintering. The electric-current pressure sintering device itself may be of any type as long as capable of performing the designated electric-current pressure sintering, an example being the device shown in the schematic diagram of FIG. 1. This device is provided inside a sintering furnace (not shown) housed inside a vacuum container (also not shown), and comprises a forming die 1 composed of a conductive material such as a hard metal, hard alloy or carbon-based material having a through hole passing in the up-down direction, and an upper punch member 2 and lower punch member 3 composed of a conductive material such as a hard metal, hard alloy or carbon-based material at the top and bottom of the forming die 1 with punch portions movably inserted in the aforementioned through hole, the space delimited by the upper punch member 2 and the lower punch member 2 of the above through hole forming the material receiving portion A. Generally, a powder material is loaded into this material receiving portion A, an upper punch member driving mechanism and lower punch member driving mechanism (not shown) are activated to compress the powder material by means of the upper punch member 2 and the lower punch member 3 to prepare a green compact, and a voltage is applied to a DC pulse current mechanism (not shown) to pass a DC pulse current between the upper punch member 2 and lower punch member 3, thus performing electric-current pressure sintering. While this electric-current pressure sintering method itself is publicly known, the present invention is characterized in that the powder material is not loaded directly into the material receiving portion A, but rather loaded into the forming die 1 together with a metallic plate material in such a state that the powder material is in contact with the metallic plate material, compressed with the upper and lower punch members 2, 3 and a voltage applied to perform electric-current pressure sintering.

That is, in the present invention, the powder material and the metallic plate material are loaded into the material receiving portion A in a state of mutual contact in order to perform electric-current pressure sintering so as to form a clad material wherein a sintered compact is covered with a metallic plate material. The electric-current pressure sintering can be performed by conventionally known methods, such as by sealing the vacuum container, putting the inside of the sintering furnace in a reduced pressure state by means of a vacuum pump or the like, loading the vacuum container with an inert gas if needed, activating the upper punch member 2 and lower punch member 3 to compress the material in the forming die 1 with a designated pressure, then passing a DC pulse current through the resulting high-density compress via the upper punch member 2 and the lower punch member 3, to heat and sinter the material. The conditions of electric-current pressure sintering must be selected so that the desired sintering results are achieved, and are determined in accordance with the type of powder being used and the degree of sintering desired. When considering the adhesion between the metallic plate material and sintered compact, and the plastic workability of the clad material which are the basic requirements of the present invention, electric-current pressure sintering in air is possible, but it can be performed, for example, in a vacuum atmosphere of 0.1 torr or less, with an electric current of 5000-30000 A, a temperature increase rate of 10-300° C./minutes, a sintering temperature of 500-650° C., a retention time of at least 5 minutes and a pressure of 5-10 MPa. With a sintering temperature of less than 500° C., it is difficult to achieve adequate sintering, and at more than 650° C., the aluminum powder or aluminum plate material can melt (530-580° C. or less is preferable).

Here, in the present invention, the powder material and metallic plate material are put in a state of mutual contact so as to form a clad material wherein the sintered compact is covered by a metallic plate material, for which the following two embodiments are contemplated and preferred.

That is, in a first embodiment as shown in FIG. 2, a metallic plate material 4 of aluminum or stainless steel is first loaded into the powder material receiving portion of the forming die 1 in contact with the punch surface of the bottom punch material 3, then the powder mixture M (or compression formed compact) obtained in step (a) is loaded, and covered from above by a metallic plate material 5. In this state, electric-current pressure sintering is performed under the aforementioned conditions.

In a second embodiment as shown in FIG. 3, the powder mixture M (or compression formed compact) obtained in step (a) is loaded into a box element 8 consisting of a bottom plate material 6 and side plate materials 7, then a lid plate material 9 is fitted from above. This container is received in the powder material receiving portion of the forming die 1, and electric-current pressure sintering is performed under the aforementioned conditions in this state. While the box element 8 in FIG. 3 is rectangular, a cylindrical box element 8 is used in the case of extrusion.

A mixture consisting of a mixed aluminum powder or a compression formed compact thereof can be sintered by electric-current pressure sintering according to any of the above methods, while simultaneously being in close contact with the upper and lower metallic plate materials 4, 5, or the bottom plate material 6 and the lid plate material 9 of the container, thus forming a clad material.

Furthermore, in the present invention, the sintering step can be multi-stacked sintering such as two-stacked sintering or three-stacked sintering. FIG. 4 shows an embodiment of two-stacked sintering, and sintering can be performed in three stacked arrangement or more using similar constructions.

In FIG. 4, 13 denotes at least one partitioning member perpendicularly intersecting with the punch movement direction, as a result of which two partition spaces are delimited in the receiving space of the forming die. While electric-current pressure sintering is performed after loading one assembly 11 of the mixture and metal plate materials into each partition space, a pair of stacked plates 10 are provided above and below, between the respective assemblies 11 and the forming die 1, and between the respective assemblies 11 and the partitioning member 13, so that the punch members or partitioning members will not be joined to the assemblies. Furthermore, in the vicinity of the peripheral portions of the stacked plates between each pair of stacked plates 10, a rectangular frame-shaped spacer 12 extending along the outer periphery of the stacked plates is provided, with upper and lower surfaces facing the opposing surfaces of the pair of stacked plates above and below. This spacer 12 prevents deformation of the contact portions of the side plate materials 7 and lid plate materials 9 during electric-current pressure sintering, thus making the box element 8 and the lid plate material 9 less susceptible to separation.

Additionally, in a preferred embodiment of the present invention, a clad material whose peripheral portions are covered by a metallic frame material such as an aluminum block material is formed in step (b), so that the load when rolling is applied to the metallic frame material, thus preventing the occurrence of cracks and fissures mostly in the side directions of the clad material. The protection of the clad material due to this metallic frame material may be achieved after electric-current pressure sintering, or before electric-current pressure sintering. It the width a of the frame material 15 is made greater, the frame material 15 is capable of receiving more of the rolling load, thus better preventing cracks or fissures in the clad material, so the width a of the frame material 15 should preferably be at least 5 mm. It should more preferably by at least 20 mm. Additionally, if the frame material 15 is composed of the same metal as the metallic plate materials and the metallic container, they will be better joined, and there will be less difference in the amount of deformation of the composition during rolling.

FIGS. 5 and 6 shove an example of attachment of a metallic frame member 15 to the peripheral portions of an assembly represented by the container 14 consisting of a box element and a lid member, wherein a frame material 15 consisting of aluminum blocks is attached at the time of electric-current pressure sintering, and the outer periphery of the frame material 15 is welded or friction stir welded after electric-current pressure sintering. In FIG. 5, reference number 16 denotes the weld padding. As can be understood from FIG. 5, if the container 14 (or the assembly, hereinafter referred to as container 14) is formed so that the corners between the bottom portion and top portion and side portions are smoothly curved, and gaps 17 are formed between the corner portions of the container 14 and the frame material 15, then aluminum blocks of the frame material 15 will melt into these gaps 17 during sintering, thus ensuring that the frame material 15 and container 14 are integrated, and improving the frictional coefficient of the frame material 15. Since powder compression occurs in the container, the thickness of the frame material 15 of the aluminum blocks should be smaller than the thickness of the container 14. If the frame material 15 of the aluminum blocks is about the same or thicker than the container 14, then the frame material 15 will receive much of the compressive force during electric-current pressure sintering, as a result of which not much of the compressive force will be applied to the container 14 and the powder inside. Conversely, if the thickness of the frame material 15 is insufficient, then pressure will not be applied to the frame material 15 in the initial stages of rolling, so it should preferably be at least 90% of the thickness of the container 14.

FIGS. 7 and 8 show another embodiment of attachment of the metallic frame material 15 to the container 14, wherein after electric-current pressure sintering, a frame material 15 consisting of aluminum blocks is attached to the peripheral portions of the container 14 forming a clad material by welding 18 or friction stir welding. This method is easy to perform and by making the frame material 15 of aluminum blocks slightly thicker than the container 14, the pressure can be applied to the frame material 15 from the initial stages. If pressure is applied to the frame material 15 in the early stages, cracks and fissures are not as likely to occur in the clad material. Additionally, since there is no need to place the frame material 15 in the electric-current pressure sintering device, the electric-current pressure sintered compact can be made that much larger.

Furthermore, FIG. 9 shows another embodiment, wherein the external shape of the peripheral portions of the container 14 constituting the outside portions of the clad material are tapered by making the container gradually thinner in the outward direction, thereby enabling the rolling load to be directed to the frame material 15. Due to such a structure, the load will be applied more to the tapered portion when the frame material 15 of the aluminum block is attached. Additionally, the container 14 for cladding can be produced with relative ease, so that the work of filling with powder in the case of compression forming such as CIP prior to the electric-current pressure sintering process can be made easier.

FIG. 10 shows a further embodiment, wherein the frame material 15 of aluminum blocks is simultaneously sintered with the container 14 at the time of electric-current pressure sintering, and after sintering, the frame material 15 and container 14 are welded or friction stir welded at their outer peripheral portions. By bending the ends of flange portions of the container 14 outward by roughly 90°, the cross sectional area of the flange portion can be increased, and the bent central portions are welded or friction stir welded at their entire peripheries. This method has the advantage of being able to raise the tensile strength of the flanges.

Additionally, as shown in FIG. 11, the metallic frame material 15 can be formed by fusing a plurality of frame members 15*a* by welding or friction stir welding, but a large force is applied to the corner portions 18 during rolling, so that the corner portions 18 can be welded to raise the strength. Additionally, in order to further raise the strength of the corner portions of the frame material 15, an integral metal frame 15 made by cutting out the central portion of an aluminum plate material by wire-cutting or by a press as shown in FIG. 13 may be used. Furthermore, a hollow aluminum extruded material cut to appropriate dimensions can be used as the metallic frame material 15.

FIG. 13 shows vet another embodiment, wherein 19 denotes the metallic plate material and 20 denotes the mixture. In this example, a metallic frame material 15 of aluminum or the like is attached to the peripheral portions of the mixture 20 before electric-current pressure sintering, and the mixture 20 and frame material 15 are sintered simultaneously. Since the aluminum in the mixture and the frame material are sintered in a melted state, a more integrated sintered compact can be obtained. While the metallic frame member 15 may consist of a plurality of aluminum block materials or the like, when considering the strength of the corner portions, it is preferable to use an integrated body obtained by cutting out the central portion of an aluminum plate material by wire-cutting or by a press, or a hollow aluminum extruded material eat to appropriate dimensions. In this case, the frame material 15 also enters the material receiving portion A, so the sintered compact will be small if the width a of the frame material is large. Therefore, a thin frame material 15 may be used, and a frame material further added outside the frame material 15 after electric-current pressure sintering.

(4) Step (c) (Plastic Working Step)

The electric-current pressure sintered compact is generally subjected to hot plastic working such as hot extrusion, hot rolling or hot forging, thus further improving the pressure sintering while simultaneously achieving the desired shape. When preparing a plate-shaped clad material, it is possible to obtain a clad plate material having a designated clad ratio with an Al plate material or an Al container by cold rolling alone. The hot plastic working may consist of a single procedure, or may be a combination of a plurality of procedures. Additionally, cold plastic working may be performed after hot plastic working. In the case of cold plastic working, the material can be made easier to work by annealing at 100-530° C. (preferably 400-520° C.) prior to working.

Since the sintered compact is clad by a metallic plate material, the surface will not have any ceramic particles that might otherwise be a point of origin for damage during plastic working or wear down the dies or the like. As a result, it is possible to obtain an aluminum composite material with good plastic workability, excelling in strength and surface properties. Additionally the resulting material which has been subjected to hot plastic working will have a surface dad with a metal, with good adhesion between the metal on the surface and the aluminum sintered compact inside, thus having corrosion resistance, impact resistance and thermal conductivity superior to aluminum composite materials whose surfaces are not clad with a metallic material.

In a preferred embodiment of the rolling process, the surface of the clad material is covered by a metallic protective plate such as a thin plate of stainless steel, Cu or soft iron prior to roiling. As a result, it is possible to prevent separation between the sintered material and the metallic plate material that can occur due to friction between the roller and the metallic plate material during rolling (especially the initial stages).

FIG. 14 is a schematic view of an example of this embodiment, wherein the clad material 23 is covered by the protective plate 21 on the front side in the direction of movement and the top and bottom surfaces. Additionally, lubrication is performed between the clad material 23 and the protective plate 21. This lubrication reduces the friction between the protective plate and the metallic plate material, making it less likely for separation to occur between the sintered compact and the metallic plate material. More specifically, for example, the electric-current pressure sintered compact can be covered by a soft iron thin plate (0.5 mm thick), the insides of the sintered compact and soft iron thin plate are provided with solid lubrication by a BN-based lubricant, and hot rolled (roller diameter ϕ 340 mm, surface length 400 mm, speed 15.2 m/min). In order to improve the bite, the roll 24 can be left without lubrication, or the leading surface of the soft iron plate can be roughened (e.g. using #120 emery paper). There is no need to use the protective plates until the rolling is completed, and their use can be discontinued once the rolling has progressed to a certain degree and the bond between the metallic plate material and the sintered compact becomes strong. Additionally, repeated rolling of the protecting plate can cause work hardening. A work hardened protective plate can scratch the clad material. Since scratches in the clad material can be the point of origin for further damage, the protective plate should be replaced with a new one after being subjected to rolling a number of times.

EXAMPLES

Herebelow, the method of production of the present invention shall be described in detail with reference to the examples.

The methods for measuring the respective physical values described in the examples are as follows.

(1) Composition

An analysis was performed by ICP emission spectrometry.

(2) Average Particle Size

A Microtrac (Nikkiso) was used to perform laser diffraction type particle size distribution measurement. The average particle size was the volume-based median.

(3) Rolling Ability

Samples were evaluated for the presence of cracks and the surface properties when rolling. Those having surface cracks on the plate surface were rated "×", those having no surface cracks but wrinkle-like irregularities were rated "○" and those without any surface cracks or irregularities were rated "◎".

(4) Structure Observation

A small piece cut from a sample was implanted in a resin, emery-polished and buff-polished, then its structure was observed by an optical microscope.

(5) Line Analysis

An EPMA device was used to study the Mg distribution in the sample used for structure observation.

Example 1

A $B_4C$ ceramic powder was evenly mixed into an aluminum alloy powder with the composition shown in Table 1, so as to take up 35% by mass. Then, containers of length 100 mm×width 100 mm×height 5 mm consisting of aluminum alloys JIS 5052 and JIS 1050 with a plate thickness of 0.5 mm were prepared, and loaded into an electric-current pressure sintering device with the aforementioned mixed powder inside the containers, then electric-current pressure sintering was performed by applying a voltage (electric current 7000 A) in a vacuum atmosphere (0.1 torr). Here, the sintering temperature was 520-550° C., the retention time was 20 minutes, the temperature increase rate was 20° C./minute, and the pressure was 7 MPa.

TABLE 1

Composition of Aluminum Alloy Powder forming Matrix Material (units: % by mass)

| Si | Mg | Fe | Cu | Mn | Cr | Ni | Al |
|---|---|---|---|---|---|---|---|
| 0.05 | 0.1 | 0.1 | 0.05 | 0.02 | 0.02 | 0.01 | bal |

Al balance includes unavoidable impurities

Test pieces were taken from the resulting sintered material, and their metallic structure was observed using an optical microscope. The microscope photographs are shown in FIGS. 15 and 16. This photograph shows that the test pieces were sintered to an adequately high density. Additionally, FIG. 16 shows that the aluminum powder alloys of the container and the inside were strongly attached.

Furthermore, the test piece used in the structure observation was subjected to line analysis for Mg content using an EPMA device. The results are shown in FIG. 17. FIG. 17 shows that the Mg in the 5052 material decreases in the vicinity of the junction plane, and Mg is detected inside the sintered compact whose matrix material is pure aluminum. That is, the Mg of the 5052 material has spread inside the sintered compact. This also shows that the 5052 material and the sintered material are strongly attached.

Next, the obtained sintered compact was cold rolled to a plate thickness of 2 mm. FIG. 18 is a photograph showing the appearance of the cold rolled material. FIG. 18 shows that there are no outward defects, and rolling is achieved. Additionally, the strength and corrosion resistance (saline spay test: appearance studied after 500 hours of immersion in saline solution at room temperature) of the cold rolled material were studied. The results are shown in Table 2.

As a comparative example, a sample obtained by electric-current pressure sintering a powder without placing in a container was cold rolled (the remaining composition and production conditions were the same). However, cracks and gouges occurred on the surface, so a rolled material was not able to be obtained. Therefore, the strength and corrosion resistance of the sintered material were studied. The results are also shown in the below Table 2.

Table 2 shows that while the examples of the present invention excel in strength and corrosion resistance as well as having good rolling ability, the comparative example is inferior to the examples of the present invention for all properties, and cracks during rolling.

TABLE 2

| | Strength | Corrosion | Rolling Ability | |
|---|---|---|---|---|
| | (MPa) | Resistance | Surface | Cracks |
| Present Invention (1050) | 120 | surface pits small | ○ | absent |
| Present Invention (5052) | 190 | no surface corrosion | ◎ | absent |
| Comparative Example (without container) | 110 | many pits | X | present |

Example 2

$B_4C$ ceramic powder was mixed into an aluminum alloy powder of the composition shown in Table 1, so as to take up 43% by mass. Then, the mixed powder was placed in a pure aluminum (JIS 1050) cylindrical container (φ 100 mm; plate thickness 2 mm), and electric-current pressure sintering was performed under the conditions described in Example 1.

Next, the resulting sintered material was heated to 480° C., and hot extruded into a flat plate of thickness 6 mm×40 mm. FIG. 19 shows a microscope photograph of the metal structure. FIG. 19 shows that the extruded material was sintered, and the container and extruded material are well-attached.

The invention claimed is:

1. A method of producing an aluminum composite material, comprising the steps of:

(a) mixing an aluminum powder and ceramic particles to prepare a mixed material;

(b) electric-current pressure sintering the mixed material together with a metallic plate material to form a clad material wherein a sintered compact is covered by a metallic plate material; and (c) subjecting the clad material to plastic working to obtain an aluminum composite material.

2. A method of producing an aluminum composite material according to claim 1, wherein said step (b) includes loading the mixed material in a forming die together with a metallic plate material in a state of contact with the metallic plate material, and subjecting to electric-current pressure sintering while compressing with a punch and applying voltage.

3. A method of producing an aluminum composite material according to claim 2, wherein said step (b) includes sandwiching the mixed material between a pair of metallic plate materials, loading in a forming die with a metallic plate materials being pressed by a punch, and compressing the mixed material together with the metallic plate material.

4. A method of producing an aluminum composite material according to claim 2, wherein said step (b) includes placing the mixed material in a metallic container having a lid plate material opposite a bottom plate material, loading in a forming die with the bottom plate material and lid plate material pressed by a punch, and compressing the mixed material together with the container.

5. A method of producing an aluminum composite material according to claim 2, wherein said step (b) includes preparing at least two assemblies of a mixed material and metallic plate materials and performing the electric-current pressure sintering with the at least two assemblies loaded in a forming die in a stacked state, to simultaneously form at least two clad materials.

6. A method of producing an aluminum composite material according to claim 5, wherein a receiving space inside the forming die is partitioned by at least one partitioning member perpendicular to a punch movement direction to delimit at least two compartments, the at least two assemblies are loaded into the at least two compartments to perform the electric-current pressure sinter.

7. A method of producing an aluminum composite material according to claim 6, wherein a pair of stacked plates are provided between the assemblies and the forming die and the assemblies and the partitioning member to perform the electric-current pressure sinter.

8. A method of producing an aluminum composite material according to claim 1, wherein the metallic plate materials are composed of aluminum or stainless steel.

9. A method of producing an aluminum composite material according to claim 1, wherein said step (a) includes mixing the aluminum powder and ceramic particles to prepare a mixed material consisting of a mixed powder.

10. A method of producing an aluminum composite material according to claim 1, wherein said step (a) includes mixing the aluminum powder and ceramic particles to prepare a mixed powder, and subjecting the mixed powder to compression forming to prepare a mixed material consisting of a compression formed compact.

11. A method of producing an aluminum composite material according to claim 1, wherein in said step (a), the aluminum powder is a pure Al powder with a purity of at least 99.0% or an alloy powder containing Al and 0.2-2% by mass of at least one of Mg, Si, Mn and Cr, and the ceramic particles take up 0.5-60% of the total mass of the mixed material.

12. A method of producing an aluminum composite material according to claim 1, wherein said step (b) includes forming a clad material whose peripheral portions are covered by a metallic frame material, and in said step (c), the plastic working is a rolling process.

13. A method of producing an aluminum composite material, comprising the steps of:

(a) mixing an aluminum powder and ceramic particles to prepare a mixed material;

(b) electric-current pressure sintering the mixed material together with a metallic plate material to form a clad material wherein a sintered compact is covered by a metallic plate material; and (c) subjecting the clad material to plastic working to obtain an aluminum composite material, wherein said step (b) includes forming a clad material whose peripheral portions are covered by a metallic frame material, and includes covering the peripheral portions of the clad material with a metallic frame material after electric-current pressure sintering, and wherein in step (c), the plastic working is a rolling process.

14. A method of producing an aluminum composite material according to claim 12, wherein said step (b) includes covering the peripheral portions of the metallic plate material and/or the mixed material with a metallic frame material before electric-current pressure sintering.

15. A method of producing an aluminum composite material according to claim 12, wherein the metallic frame material is formed by attaching a plurality of frame members by welding or friction stir welding.

16. A method of producing an aluminum composite material according to claim 12, wherein the metallic frame material is composed of a single piece.

17. A method of producing an aluminum composite material according to claim 12, wherein the metallic frame material is an aluminum material.

18. A method of producing an aluminum composite material according to claim 1, wherein said step (c) includes covering the surface of the clad material with a metallic protective plate before performing the plastic working.

19. A method of producing an aluminum composite material according to claim 18, wherein said step (c) includes covering the clad material with the protective plate on a front side in a direction of movement and on top and bottom surfaces.

20. A method of producing an aluminum composite material according to claim 18, wherein lubrication is performed between the clad material and protective plate.

21. A method of producing an aluminum composite material according to claim 18, wherein the protective plate is a thin plate composed of stainless steel, Cu, or soft iron.

* * * * *